United States Patent [19]

Boreland et al.

[11] 4,382,008

[45] May 3, 1983

[54] CORROSION INHIBITORS AND COMPOSITIONS CONTAINING THEM

[75] Inventors: William Boreland, Hartlepool; John M. Dossor, Redcar; Geoffrey S. Jaques, Great Ayton, all of England

[73] Assignee: Imperial Chemical Industries Limited, London, England

[21] Appl. No.: 236,041

[22] Filed: Feb. 20, 1981

[30] Foreign Application Priority Data

Mar. 12, 1980 [GB] United Kingdom ..... 8008297

[51] Int. Cl.[3] ..... C09K 5/00

[52] U.S. Cl. ..... 252/75; 252/77; 252/79; 252/389 R; 252/394; 252/396; 252/76

[58] Field of Search ..... 252/75, 76, 77, 79, 252/389 R, 390, 392, 394, 396

[56] References Cited

U.S. PATENT DOCUMENTS

| | | | |
|---|---|---|---|
| 2,426,496 | 8/1947 | Farley | 252/395 |
| 2,803,603 | 8/1957 | Meighen | 252/75 |
| 3,931,029 | 1/1976 | Dutton et al. | 252/76 |
| 4,242,214 | 12/1980 | Lambert | 252/75 |

FOREIGN PATENT DOCUMENTS

| | | |
|---|---|---|
| 945638 | 1/1964 | United Kingdom . |
| 976964 | 12/1964 | United Kingdom . |
| 1004259 | 9/1965 | United Kingdom . |
| 2036062 | 6/1980 | United Kingdom . |

*Primary Examiner*—P. E. Willis, Jr.

*Attorney, Agent, or Firm*—Cushman, Darby & Cushman

[57] ABSTRACT

Corrosion inhibitors for aqueous media comprise a triazole, an alkali metal borate, benzoate, and silicate and an alkali metal salt of a $C_7$ to $C_{13}$ dibasic acid. They may be used in antifreeze compositions for motor vehicles. Since neither nitrites and amines are required the danger of forming toxic nitrosamines by the reaction of these materials is overcome.

12 Claims, No Drawings

CORROSION INHIBITORS AND COMPOSITIONS CONTAINING THEM

This invention relates to corrosion inhibitors and compositions containing them.

In heat exchange systems, for example domestic central heating systems, motor vehicle cooling systems and the like, it is common to use a heat exchange fluid comprising large quantities of water. If the fluid comes into contact with a number of different metals for example solder, copper, brass, steel, cast iron and/or aluminium corrosion problems may become acute both because of the need to protect each of the metals individually against corrosion and also because electrolytic cells may be set up between the different metals present. In the case of motor vehicle cooling systems the problem is further exacerbated by the need in many parts of the world to include an antifreeze component in the heat exchange fluid during the winter in order to protect the heat exchange fluid from freezing during cold weather. Common antifreeze components are organic liquids which reduce the freezing point of water and are relatively stable to the working conditions encountered; they include methanol (which is however, somewhat volatile and thus tends to be lost by evaporation) ethylene glycol and propylene glycol. The most common is ethylene glycol; this may if desired be used in admixture with methanol and/or propylene glycol. Other organic liquids for example ethanol may be used but considerations of cost effectiveness and volatility generally favour ethylene glycol.

A number of corrosion inhibitor systems are already known. Many contain nitrites and some others contain amines. Although it seems unlikely that these materials are individually health hazards it is possible that different corrosion inhibitors may become mixed. Typically a motorist may have the cooling system of his car filled with a diluted corrosion inhibited antifreeze by a garage at the onset of winter and may "top-up" the system from time to time using a different brand of corrosion inhibited antifreeze and water. Alternatively a motorist may buy one brand of corrosion inhibited antifreeze one year and another the next year and may use the remnants of the previous years supply as well as his new supply in filling the cooling system. If mixtures of amines and nitrites are present they tend to form nitrosamines in the system and these are believed to be carcinogenic. (See for example Chemical Week Oct. 11, 1978 page 40 and Aug. 23, 1978 page 16).

It is an object of this invention to provide an inhibitor composition which overcomes the need to use nitrites and amines whilst still providing very efficient inhibition of corrosion.

According to the invention a corrosion inhibitor comprises a triazole, preferably 2 to 50 parts by weight, an alkali metal borate preferably in an amount sufficient to give a boron content of 5 to 60 and more preferably 10 to 30 parts by weight, an alkali metal benzoate or homologue thereof, preferably 100 to 500 and more preferably 150 to 300 parts by weight, an alkali metal silicate sufficient to provide water soluble silicate preferably in an amount of 1.5 to 15 parts by weight expressed as $SiO_2$ and an alkali metal salt of a $C_7$ to $C_{13}$ dibasic organic acid, preferably 15 to 250 and more preferably 20 to 150 parts calculated as the free acid, the corrosion inhibitor giving at a temperature of 25° C. a pH in a 2% solution of the corrosion inhibitor in water in the range 6.5 to 10 and preferably 7 to 9.

The composition may if desired be incorporated into an antifreeze composition by dissolving it in 10,000 parts by weight of an antifreeze component as aforesaid, especially ethylene glycol. The antifreeze composition may if desired contain a small amount of water to improve the solubility of the corrosion inhibitor, colouring matter, anti-foaming agents and other materials if desired.

The antifreeze composition may be diluted in a ratio of 2:1 and preferably 1:2 to 1:5 by volume with water to produce a heat exchange fluid suitable for use in motor vehicle cooling systems.

It is preferred that the dibasic acid should have 9 to 12 carbon atoms. Sebacic acid is suitably present and very suitably a mixture of dibasic acids having 9 to 12 carbon atoms may be employed.

The triazole is suitably benzotriazole or tolyltriazole.

The alkali metal silicate is suitably an alkali metal metasilicate.

A suitable homologue of the benzoate is the toluate.

The alkali metal borate may be for example a sodium tetraborate.

The alkali metals of the inhibitor are suitably sodium or potassium or a mixture thereof.

EXAMPLE

Antifreeze formulations were prepared by dissolving the appropriate compounds in the indicated amounts in monoethylene glycol. Concentrations are in % by weight of the total composition.

| Formulation | A | B | C | D | E | F |
|---|---|---|---|---|---|---|
| Tolyltriazole | 0.2 | 0.2 | 0.2 | 0.1 | 0.1 | 0.1 |
| $Na_2B_4O_7.5H_2O$ | 1.6 | 1.6 | 1.6 | 0.7 | 0.7 | 0.8 |
| Sodium Benzoate | 2.6 | 2.6 | 2.6 | 2.6 | 2.6 | 2.5 |
| $Na_2SiO_3.5H_2O$/Water 50% by weight soln | 0.2 | 0.2 | 0.2 | 0.2 | 0.2 | 0.24 |
| Sodium Nitrite | 0.3 | 0.3 | — | 0.3 | — | — |
| Disodium Sebacate | — | — | — | — | — | 0.3 |
| Sodium Nitrate | — | 0.08 | — | 0.1 | — | — |

The formations were tested by the following test methods.

CORROSION RESULTS

1 Hot Glassware Test (American Society of Testing Materials Standard D 1384 - 70, Reapproved 1975)

| | Weight loss (mg/test coupon) | | | | | |
|---|---|---|---|---|---|---|
| Metal | A | B | C | D | E | F |
| Copper | 3 | 1 | 2 | 1 | 1.5 | 0 |
| Solder | 2 | 3 | 3.5 | 5 | 10 | 6 |
| Brass | 3 | 2 | 1.5 | 2 | 1 | 0 |
| Steel | 4 | 0 | 6 | 2 | 7.5 | 5 |
| Cast Iron | 3 | +1 | 15* | 2 | 332.5+ | 3 |
| Cast Aluminium | 6 | 6 | 6 | 5 | 10* | 2 |

2 Cold Glassware (British Standard Test 5117)

| | Weight loss (mg per specimen) | | |
|---|---|---|---|
| Metal | A | B | F |
| Copper | 3 | 2 | 0 |
| Solder | 7 | 7 | 3 |
| Brass | 1 | +1 | 1 |
| Steel | 7 | 1 | 3 |
| Cast Iron | 6 | 2 | 5 |

-continued

| | | | |
|---|---|---|---|
| Cast Aluminium | 19 | 9 | 3 |

*Slight crevice attack
+General attack

We claim:

1. A corrosion inhibitor which comprises: from 2 to 50 parts by weight of a triazole, an alkali metal borate in an amount sufficient to give a boron content of 5 to 60 parts by weight, from 100 to 500 parts by weight of an alkali metal benzoate or toluate, an alkali metal silicate sufficient to provide water soluble silicate and present in an amount of 1.5 to 15 parts by weight expressed as $SiO_2$, and from 15 to 250 parts by weight, calculated as the free acid, of an alkali metal salt of a $C_7$ to $C_{13}$ dibasic organic acid, the corrosion inhibitor giving at a temperature of 25° C. in a 2% solution in water a pH in the range 6.5 to 10.

2. A composition as claimed in claim 1 in which the alkali metal is sodium and/or potassium.

3. A composition as claimed in claim 1 in which the dibasic acid has 9 to 12 carbon atoms and the triazole is benzotriazole or tolyltriazole.

4. A composition as claimed in claim 1 in which the alkali metal silicate is a metasilicate, an alkali metal benzoate is present and the alkali metal borate is a sodium tetraborate.

5. An antifreeze composition which comprises a corrosion inhibitor as claimed in claim 1 and 10,000 parts by weight of the antifreeze component.

6. A composition as claimed in claim 5 in which the antifreeze component is ethylene glycol.

7. A heat exchange fluid which comprises an antifreeze composition as claimed in claim 5 or 6 and 0.5 to 5 parts by volume of water per part by volume of antifreeze composition.

8. A heat exchange system comprising a heat exchange liquid which comprises a corrosion inhibitor as claimed in claim 1.

9. A composition as claimed in claim 1, 2, 3 or 4 wherein the alkali metal benzoate is present in an amount to give a boron content of 10 to 30 parts by weight.

10. A composition as claimed in claim 1, 2, 3 or 4 wherein the alkali metal benzoate or toluate is present in an amount of from 150 to 300 parts by weight.

11. A composition as claimed in claim 1, 2, 3 or 4 wherein the alkali metal salt of the $C_7$ to $C_{13}$ dibasic organic acid is present in an amount of from 20 to 150 parts by weight, calculated as the free acid.

12. A composition as claimed in claim 1 or 3 wherein the dibasic organic acid is sebacic acid.

* * * * *